US007770560B2

(12) United States Patent
Ulrey et al.

(10) Patent No.: US 7,770,560 B2
(45) Date of Patent: Aug. 10, 2010

(54) SYSTEM AND CONTROL METHOD FOR AN ENGINE HAVING TWO TYPES OF FUEL INJECTORS

(75) Inventors: Joseph Norman Ulrey, Dearborn, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 313 days.

(21) Appl. No.: 12/049,437

(22) Filed: Mar. 17, 2008

(65) Prior Publication Data

US 2009/0229570 A1 Sep. 17, 2009

(51) Int. Cl.
*F02M 51/00* (2006.01)
*F02B 15/00* (2006.01)

(52) U.S. Cl. ..... 123/431; 123/478; 123/490

(58) Field of Classification Search ..... 123/1 A, 123/295, 299, 300, 304, 305, 431, 478, 480, 123/490, 575; 701/101–105
See application file for complete search history.

(56) References Cited

U.S. PATENT DOCUMENTS

| | | | | |
|---|---|---|---|---|
| 4,709,233 | A | 11/1987 | Duval | |
| 6,668,804 | B2 | 12/2003 | Dobryden et al. | |
| 6,951,210 | B2 | 10/2005 | Landi et al. | |
| 7,216,627 | B2 | 5/2007 | Ito et al. | |
| 7,225,787 | B2 | 6/2007 | Bromberg et al. | |
| 7,281,517 | B2 | 10/2007 | Miyazaki et al. | |
| 7,395,786 | B2 * | 7/2008 | Leone et al. | 123/431 |
| 7,426,916 | B2 * | 9/2008 | Reed et al. | 123/299 |
| 7,484,495 | B2 * | 2/2009 | Kamio et al. | 123/431 |
| 7,640,914 | B2 * | 1/2010 | Lewis et al. | 123/431 |
| 2006/0180121 | A1 | 8/2006 | Wickman et al. | |
| 2006/0207555 | A1 | 9/2006 | Ito et al. | |
| 2006/0207568 | A1 | 9/2006 | Miyazaki et al. | |
| 2009/0282810 | A1 * | 11/2009 | Leone et al. | 701/103 |
| 2009/0308367 | A1 * | 12/2009 | Glugla | 123/299 |

* cited by examiner

*Primary Examiner*—Willis R Wolfe, Jr.
(74) *Attorney, Agent, or Firm*—Allan J. Lippa; Alleman Hall McCoy Russell & Tuttle LLP

(57) ABSTRACT

A reduced cost dual fuel injection system and method is described. Port fuel injectors and direct fuel injectors may be operated by using common injector drivers.

25 Claims, 8 Drawing Sheets

SYSTEM AND CONTROL METHOD FOR AN ENGINE HAVING TWO TYPES OF FUEL INJECTORS

FIELD

The present description relates to a system and method for controlling two different types of fuel injectors that inject fuel to the cylinder of an internal combustion engine.

BACKGROUND

A system for operating a dual fuel injection engine is described in U.S. Pat. No. 7,281,517. This patent describes a supplying fuel to a cylinder of an engine using a port fuel injector and a direct fuel injector. The port fuel injector timing and direct fuel injector timing can be varied to change the total amount of fuel injected to the cylinder. The system appears to use separate fuel pumps and injector drivers to enable individual control of direct and port fuel injectors so that the fraction of fuel that the port or direct injector provides to the cylinder can be varied with engine operating conditions.

The above-mentioned system can also have several disadvantages. For example, adding double the number of fuel injectors and fuel pumps can more than double the injection system cost as compared to a comparable port only fuel injection system. Further, additional wires and control circuitry are required to control and operate the two types of fuel injectors. Further still, the additional wiring and control circuitry can increase the space and weight necessary to implement the described system.

The inventors herein have recognized the above-mentioned disadvantages and have developed a system and method that offers substantial improvements.

SUMMARY

One embodiment of the present description includes a method for controlling fuel port and direct fuel injectors configured to deliver fuel to a cylinder of an internal combustion engine, the method comprising: flowing a first current through a second direct injector to inject fuel to a second cylinder of an internal combustion engine by way of a first command; flowing a second current through a first port injector so that fuel is injected to a first cylinder of an internal combustion engine during at least a portion of the interval when said second direct injector is injecting fuel to said second cylinder, said second current flowing by way of said first command and a second command. This method overcomes at least some disadvantages of the above-mentioned system.

Port and direct fuel injector driver and control circuitry can be configured to reduce the number of wires and injector drivers necessary to implement a dual injector fuel system. In one example, control wires and drivers for a direct injection fuel injector can be used to operate a port fuel injector and a direct fuel injector while still permitting different amounts of fuel to be delivered from each injector. This allows a dual injector fuel injection system to be designed to use less vehicle space, at a lower cost, and at a lower weight.

The present description can provide several advantages. Namely, the system and method can reduce wiring costs for a dual fuel injector system. Further, existing direct injector driver circuitry can be used to operate direct and port fuel injectors. Further still, vehicle weight can be reduced because fewer components are necessary to operate the present fuel system as compared to other dual fuel injector systems.

The above advantages and other advantages, and features of the present description will be readily apparent from the following Detailed Description when taken alone or in connection with the accompanying drawings.

BRIEF DESCRIPTION OF THE DRAWINGS

The advantages described herein will be more fully understood by reading an example of an embodiment, referred to herein as the Detailed Description, when taken alone or with reference to the drawings, wherein.

DETAILED DESCRIPTION

Figure 1:
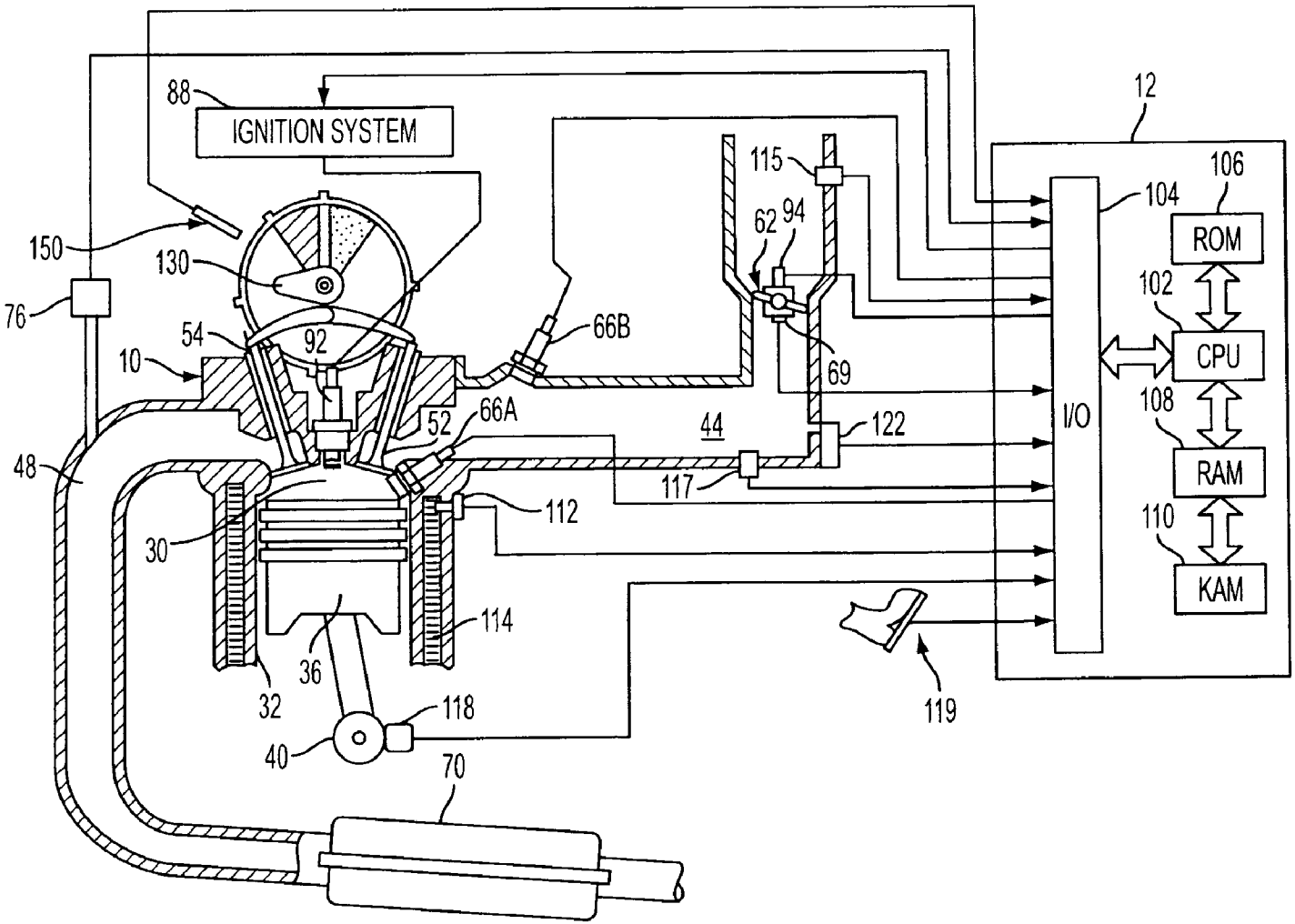
FIG. 1 is a schematic diagram of an engine, its fuel system, and its control system.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is known communicating with intake manifold 44 and exhaust manifold 48 via respective intake valve 52 an exhaust valve 54. Each intake and exhaust valve is operated by a mechanically drive cam 130. Alternatively, intake valves and/or exhaust valves may be operated by electrically controlled valves.

Intake manifold 44 is shown communicating with electronic throttle 94 that adjusts throttle plate 62. Fuel is injected directly into cylinder 30 by way of fuel injectors 66*a* and 66*b*. Injector 66A injects fuel directly into cylinder 30 whereas injector 66B injects fuel into the cylinder port upstream of intake valve 52. Fuel is delivered to fuel injector 66A by an injection pump (not shown). The injection pump may be mechanically driven by the engine or electrically driven. A lift pump supplies fuel to the injection pump from the vehicle's fuel tank (not shown). The lift pump may be configured to supply fuel to the port injectors if desired. Alternatively, another fuel pump can be used to supply port injector 66B with fuel from a vehicle fuel tank.

Distributor-less ignition system 88 provides ignition spark to combustion chamber 30 via spark plug 92 in response to controller 12. Universal Exhaust Gas Oxygen (UEGO) sensor 76 is shown coupled to exhaust manifold 48 upstream of catalytic converter 70. Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, and read-only-memory 106, random-access-memory 108, 110 Keep-alive-memory, and a conventional data bus. Input/output ports 104 may include a variety of signal processing and buffering devices. For example, processor signals are routed to injector driver circuits that increase the current capacity available to drive higher current demanding devices such as fuel injectors. Controller 12 is shown receiving various signals from sensors coupled to engine 10, in addition to those signals previously discussed, including: engine coolant temperature (ECT) from temperature sensor 112 coupled to water jacket 114; a position sensor 119 coupled to a accelerator pedal; a mass air flow sensing device 115; an engine manifold pressure (MAP) sensor 122 coupled to intake manifold 44; cam position sensor 150; a throttle position sensor 69; a measurement (ACT) of engine air amount temperature or manifold temperature from temperature sensor 117; and a engine position sensor from a Hall effect sensor 118 sensing crankshaft 40 position. In one aspect of the present description, engine position sensor 118 produces a predetermined number of equally spaced pulses every revolution of the crankshaft from which engine speed (RPM) can be determined.

Storage medium read-only memory 106 can be programmed with computer readable data representing instructions executable by processor 102 for performing the methods described below as well as other variants that are anticipated but not specifically listed.

Figure 2:
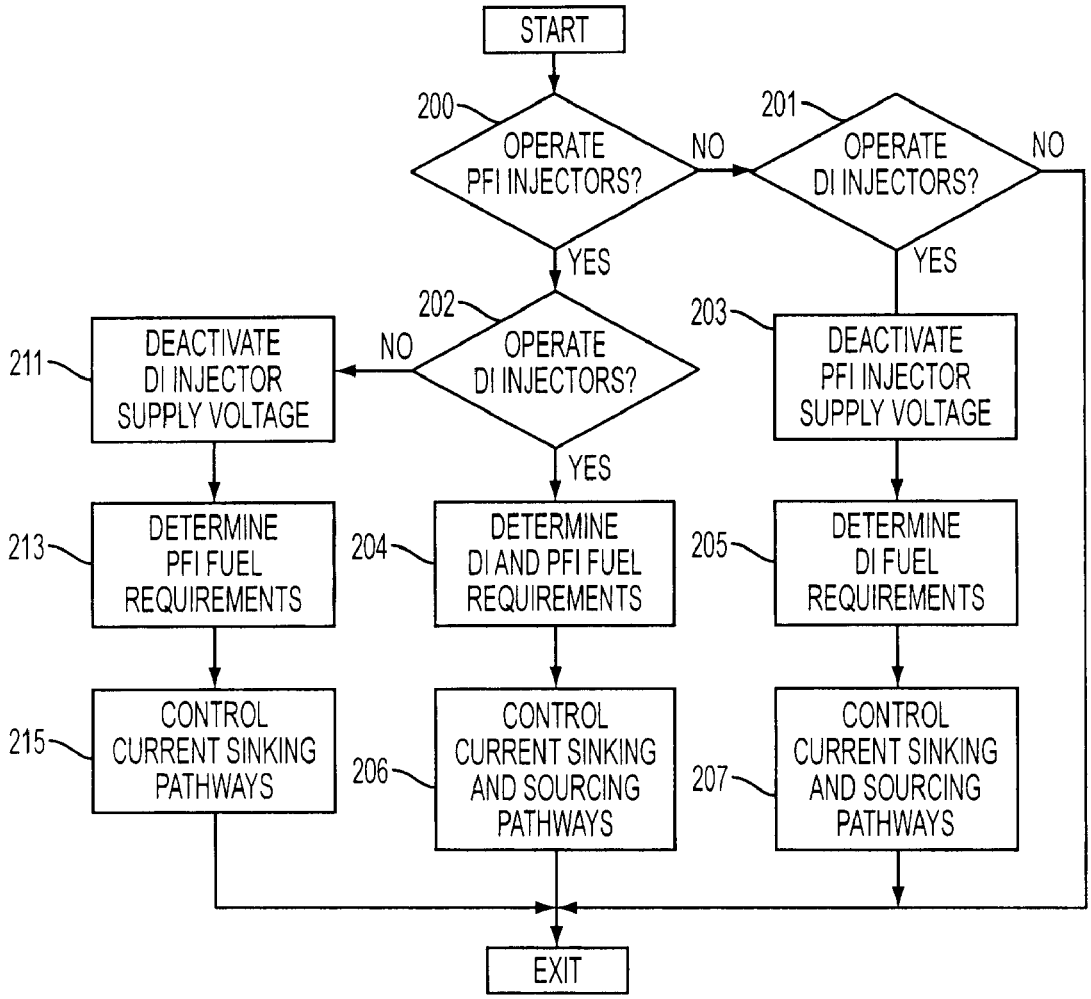
FIG. 2 is a flowchart of an example fuel injection control strategy.

Referring now to FIG. 2, a flow chart of an example dual fuel control method is shown. The method of FIG. 2 allows direct and port injectors to be operated individually or together during a cycle of a cylinder (a cycle of a cylinder is defined herein as the degrees of crankshaft rotation over which the operations related to combustion repeat; 720 crankshaft degrees for a four cycle cylinder, for example; although, a cylinder cycle may be less than or greater than 720 degrees; 360 crankshaft degrees for a 2-stroke cylinder cycle, for example) using driver circuitry that is shared between both types of injectors.

In some designs, direct injector driver circuitry can be configured to use three control lines and three drivers to operate a pair of direct injectors. Thus, three wires are required between a control unit and two direct injectors.

On the other hand, port injectors are typically supplied power via a power wire and a second wire that returns to the control module where driver circuitry can connect the wire with a lower potential voltage reference. The injector is actuated when the driver circuitry provides a current path to the low potential. This configuration requires a power wire leading to a power source and a control wire leading to the control module for each port fuel injector.

The present description provides for configuring direct injectors and port injectors such that four injectors (i.e., two direct and two port injectors) can be operated using common driver circuitry.

Figure 5:
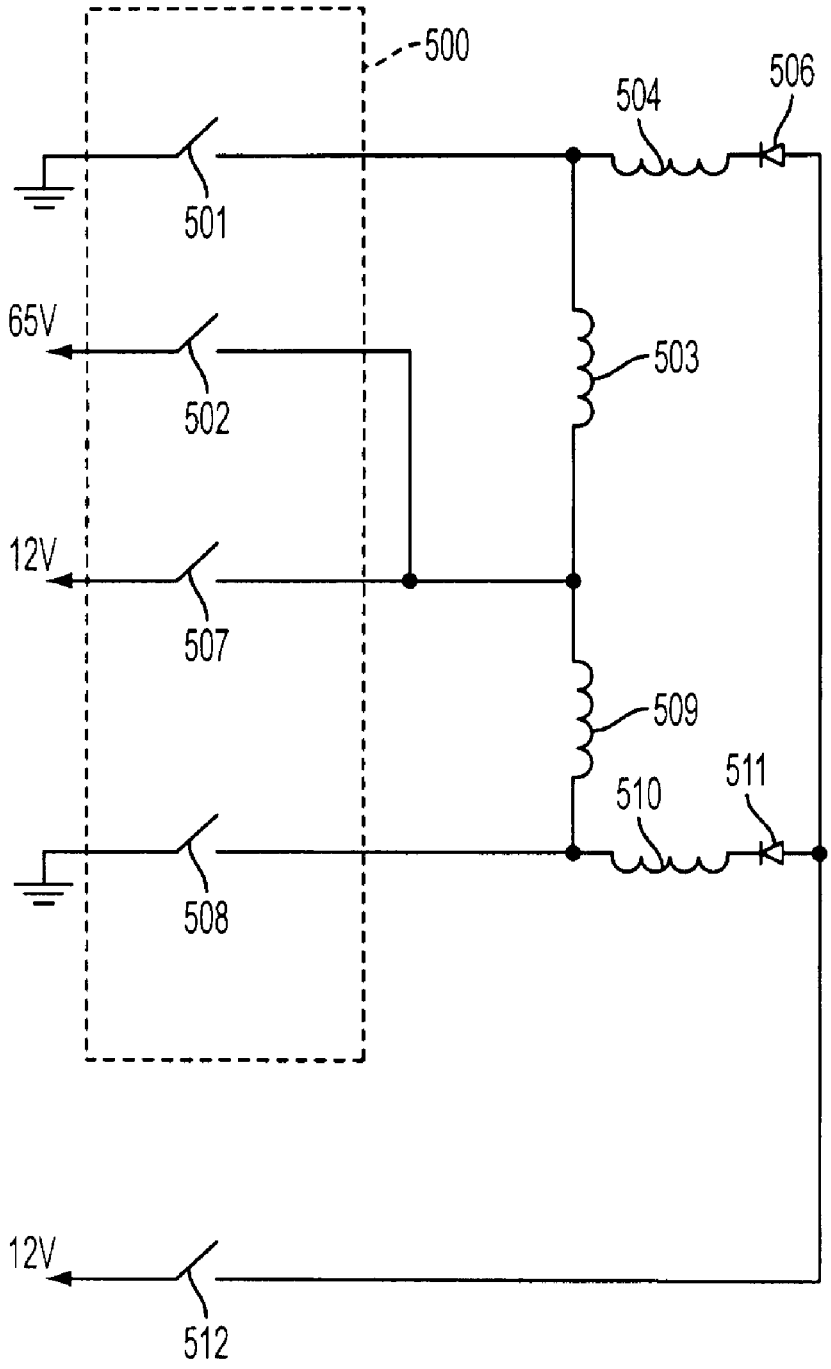
FIG. 5 is an example circuit diagram for the present fuel injection system.

In one example, low side drivers, or drivers that sink current, are used to control both direct and port injectors, see FIG. 5 for example. Since direct injectors are driven by low and high side driver circuitry (i.e., high side drivers source current to the direct injectors), the low side drivers can provide a path for current to go toward a lower potential without necessarily operating the direct injector. This allows a controller to use the sink paths to operate port fuel injectors independently of direct injectors. And since power supplied to port injectors can be interrupted independent of the direct injector low and high side drivers, port injectors can be deactivated by interrupting power flow to the port injectors without disturbing the operation of direct injectors. Thus, direct and port injectors may be operated independently or together with little more circuitry than that which is required for a direct injector. As a result, fewer wires are required between the injector controller and the injectors.

Continuing with FIG. 2, at step 200, the routine determines if it is desirable to operate with port fuel injectors. If so, the routine proceeds to step 202. If not, the routine proceeds to step 201.

Determination of whether or not to use port injectors can be accomplished in several ways. In one example, engine speed and load are used to determine when use of port injectors is desired. Further, other engine/vehicle operating conditions may be used to determine if port fuel injection is desired. For example, it may be desirable to operate port injectors during an engine start when engine temperature is low because engine emissions may be improved if the fuel vaporizes well when the intake valve opens. However, in some configurations where different fuel types are injected between the two injectors (e.g., gasoline is injected via the port injector and alcohol is injected via the direct injector), port fuel injector operation may be determined from engine operating conditions as well as fuel type.

At step 202, the routine determines if it is desirable to also operate direct injectors. If so, the routine proceeds to step 204. Otherwise, the routine proceeds to step 211. Like port injection, operation of direct injectors can be determined in a variety of ways including those described above.

At step 204, the routine determines the fuel requirements for direct and port injectors.

In one example, the fuel charging path (i.e., direct injection or port injection) and fuel type can be configured and changed or adjusted based on predetermined stored empirical mapping data. In one embodiment, the amount of fuel to be delivered is based on an open-loop estimate that is related to driver torque demand, engine temperature, and engine speed. For example, if an operator requests a first desired engine torque at a first engine speed, the engine controller indexes a table or function that defines which injectors to activate. That is, the routine selects direct injection mode (DI), port pulse direct injection (PFI+DI), or port injection (PFI). Alternatively, a state machine can be used to select which injectors to operate for a given or specific operating condition. Further, the amount of fuel is looked up for each injector and fuel type. For example, looking up operating parameters for one operating condition may yield gasoline port fuel injection at 6 Kg/hr and direct ethanol injection at 0.25 Kg/hr, while another operating condition may yield direct injection of ethanol at 8 Kg/hr. Thus, different operating conditions may yield different injection strategies (i.e., DI, DI+PFI, PFI), different fuel types, and different amounts of fuel being delivered by each injector that supplies fuel to a cylinder.

The looked-up fuel demand can be adjusted based on the sensed exhaust gas oxygen and engine knock sensors so that the desired engine torque is delivered at the desired air-fuel ratio. The fuel demand for each of a cylinder's injectors (DI and PFI) is converted into one or more fuel pulse widths (i.e., the duration of current or voltage that is supplied to a fuel injector) that correspond to the opening duration of the DI and/or PFI injector necessary to deliver the desired fuel amount.

Note that fuel pulse widths delivered to the DI and PFI injectors may be structured to deliver fuel to a cylinder using a plurality of individual injections during a cycle of a cylinder. The duration of each pulse width may be looked-up from tables or functions that contain empirical determined injector timings that cause the prescribed amount of fuel to be delivered to the cylinder at the prescribed crankshaft intervals for the present operating conditions.

After the injector types and fuel amounts have been selected the routine proceeds to step 206.

At step 206, the routine controls switches or similar devices to operate engine injectors. In one embodiment, the routine operates PFI injectors by controlling switches that sink power from PFI injectors. The routine also controls a switch that can be used to connect and disconnect power from one or more PFI injector groups, see FIG. 5 switches 512, 501, and 508 for example. Thus, the routine can control current flowing to and from the PFI injector groups.

The routine also controls current flow to DI injectors. The DI injectors may be wired in pairs such that a two power sources are switched and supplied to two DI injectors, see FIG. 5 switches 502 and 507 for example. The routine also controls two low side drivers that sink (i.e., provides a path to a lower potential) current from each injector of the injector pair respectively, see FIG. 5 switches 501 and 508 for example.

It should be noted that in alternative embodiments, other wiring configurations are anticipated. For example, PFI injectors in a group may be sourced power from individual circuit paths or switches while a switch deactivates a path leading to a lower potential (i.e., a current sink). In a further example, a pair of DI injectors may be sourced current from individual current paths by individual switches, while a single switch or current path controls current sinking from the DI injector pair.

In order to lower system cost, the routine works in conjunction with a wiring scheme that makes it possible to operate DI and PFI injectors of each engine cylinder using shared components. FIG. 5 is one example wiring configuration that enables a reduction in system cost for a system that operates DI and PFI injectors. With this configuration, the routine controls switches that operate DI and PFI injectors based on the fueling requirements determined in step 204.

When both DI and PFI injector operation is desired, the routine controls the current paths of one cylinder's DI injector along with the current paths of another cylinder's PFI injector. Specifically, the routine controls the current path of a first DI injector supplying fuel to a first cylinder by commanding one or more switches to open or close based on the desired DI injector pulse widths determined in step 204. That is, current is allowed to flow or is stopped from flowing through the first DI injector such that the first DI injector is actuated to deliver the desired DI injector fuel pulse width and fuel amount. The DI injection occurs during the crankshaft interval that encompasses the intake and compression strokes. During the same time period or crankshaft rotation interval (i.e., the crankshaft angle that the first DI injector is injecting fuel to the first cylinder), the routine also commands fuel to be injected to a second cylinder by opening or closing one or more switches to actuate a second PFI injector. Specifically, the second PFI injector is actuated by controlling current flow through drivers that are wired in common with the first DI injector. The PFI injector may be actuated during the exhaust, power, and compression strokes of the cylinder that receives the port injected fuel. Likewise, the first PFI injector supplying fuel to the first cylinder is actuated by commanding switches that are used in common with switches that can be used to actuate the second DI injector, which supplies fuel to the second cylinder. When switches are common to DI injectors that supply fuel to one cylinder and PFI injectors that supply fuel to another cylinder, a single command that operates the common switch can be used to actuate both injectors at the same time. Thus, the port injector of one cylinder can be operated at the same time as a DI injector of a different cylinder by issuing a single command when the injectors are wired properly (e.g., see FIG. 5). A second command can be used to actuate different DI and PFI injectors that inject fuel to the same cylinders as the previously described DI and PFI injectors. Thus, a first command can be used to inject fuel from a DI injector to a cylinder and a second command can be issued to inject fuel using PFI to the same cylinder. The same first and second commands also cause fuel to be injected to a different cylinder by way of DI and PFI injectors.

The DI injection period for a particular cylinder can be limited to the cylinder's intake and compression strokes so that the fuel injected during a cylinder cycle is combusted during the same cylinder cycle. On the other hand, the injection timing of the port injector can be longer in duration because the valve opening timing determines when fuel will enter the cylinder. Because DI injector timing is more constrained than PFI injector timing, and because the PFI injector injects fuel while fuel is being injected by the DI injector, the DI injector timing determines at least the initial pulse width of the PFI injector timing during a cycle of a cylinder when both PFI and DI injectors are used during the same cylinder cycle. Any fuel injected by the PFI injector after the DI injection period is initiated by commanding the DI low side drivers to sink current when the high side drivers are not configured to source current to the DI injector.

Because it may not be possible to inject the entire desired amount of fuel from the PFI injector during the DI injection period of the other cylinder, the PFI injector may have to be actuated one or more times after the other cylinder's DI injection period to deliver all of the request port injected fuel. This can be accomplished by sinking current from the PFI injector through the low side drivers of the DI driver circuitry without enabling the DI injector high side driver.

The total amount of fuel injected to a cylinder can be expressed as:

$$Cyl_\text{Fuel}=DI_\text{slope}\cdot DI_\text{time}+(PFI_\text{slope}\cdot \text{DI_time}+PFI_\text{slope}\cdot PFI_\text{time})$$

where Cyl_fuel is the amount of fuel entering a cylinder, DI_slope is a function that characterizes the amount of fuel per unit time that the DI injector will deliver at a given fuel pressure, DI_time is the amount of time that the DI injector is actuated, PFI_slope is a function that characterizes the amount of fuel per unit time that the PFI injector will deliver at a given fuel pressure, and PFI_time is the amount of time that the PFI injector is actuated.

Note that the steps described in FIG. 2 are used to determine fueling for each individual cylinder of an engine.

The driver switches or equivalent devices are operated in accord with the desired fuel pulse width determined in step 205. After controlling injection drivers in step 206, the routine proceeds to exit.

At step 201, the routine determines if it is desirable to operate DI injectors. If not, the routine proceeds to exit. In one example, DI and PFI injectors may not be operated during vehicle decelerations so that fuel consumption may be reduced. If DI injector operation is requested, the routine proceeds to step 203.

At step 203, the PFI injector supply voltage is interrupted to the PFI injectors. By deactivating power to the PFI injectors, DI injectors may be freely actuated without injecting fuel into a cylinder's port. The PFI injector supply voltage may be deactivated by commanding driver switches to open or close. See FIG. 5, switch 512 for an example PFI control switch. After the PFI injector supply is deactivated the routine proceeds to step 205.

At step 205, the DI fuel requirements are determined. Similar to step 204, DI fuel requirement may be determined from the operator torque demand, engine temperature, and engine speed. The operator torque demand and engine speed are used to index a table or function of empirically determined amounts of DI fuel. After determining the amount of DI fuel, the routine proceeds to step 207.

At step 207, the routine commands switches or similar devices to source and sink current flow to DI injectors. In one example, the DI injector is pulled to an open state using a first voltage and then is held in place using a second voltage. The command sourcing current to the DI injector may be modulated to reduce injector heating if desired. The switches or equivalent devices are operated in accord with the desired fuel pulse width determined in step 205. See FIG. 7 for an example DI injection sequence. The routine then exits after controlling the DI injector.

Referring now to step 211, the routine deactivates a DI injector by commanding switches or similar devices to open or closed positions that stop current or voltage from being sourced to the DI injector. By interrupting power sourced to a DI injector, the DI low side switches or similar devices can be controlled such that PFI injectors operate without causing fuel to flow through the DI injectors. See FIG. 5 switches 502 and 507 for example. After deactivating the DI injector supply power the routine proceeds to step 213.

In step 213, the PFI fuel requirements are determined. Similar to step 204 and 205, the amount of PFI fuel injected fuel is determined in response to driver demand, engine speed, and engine temperature. These parameters are used to index tables or functions that hold empirically determined amounts of fuel that when injected to the cylinder create the desired engine torque. After determining the PFI fuel requirements, the routine proceeds to step 215.

At step 215, the routine commands switches or similar devices, and controls current sinking paths for DI and PFI injectors. Since current sources for the DI injector driver were commanded off, operating the current sinking switches has no effect on the PFI injectors and the PFI injectors remain off. The current sink switches or equivalent devices are operated in accord with the desired fuel pulse width determined in step 213. After controlling the DI fuel injector pulse width, the routine exits.

Figure 3:
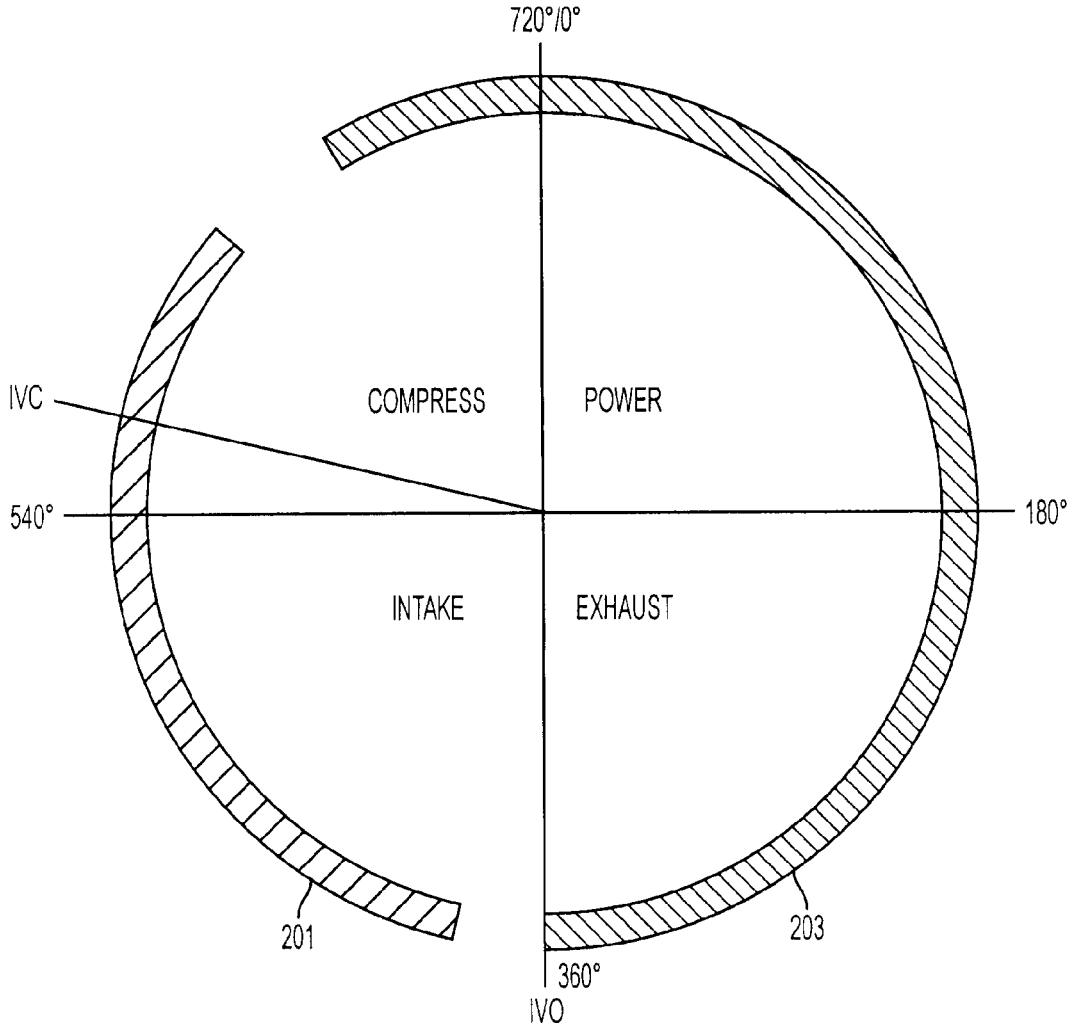
FIG. 3 is an example injection period window for a direct fuel injector and a port fuel injector.

Referring now to FIG. 3, an example injection period window for a direct fuel injector and a port fuel injector is shown. The horizontal and vertical axes represent different positions in the cycle of a cylinder. The ring represents the crankshaft angular interval over which PFI and DI injection may occur. The vertical axis marked 720°/0° represents piston top-dead-center for a cylinder in a combustion stroke; the horizontal axis marked 180° represents bottom-dead-center of the cylinder's power stroke; the vertical axis marked 360° represents top-dead-center of the cylinder's exhaust stroke; and the horizontal axis marked 540° represents bottom-dead-center of the cylinder's intake stroke. Example intake valve opening (IVO) and intake valve closing (IVC) positions are also shown to provide additional cylinder timing references.

The area marked 201 is the portion of a cylinder cycle in which direct injection can occur. Of course, this injection window can be expanded or compressed somewhat, if desired.

The area marked 203 is the portion of a cylinder cycle in which port injection can occur. This injection window can be expanded or compressed also, if desired.

This illustration shows that it is possible to deliver fuel from DI and PFI injectors without having overlapping DI and PFI injection events. As a result, it is possible to operate DI and PFI injectors using drivers and wiring that are common to both injectors.

Figure 4:
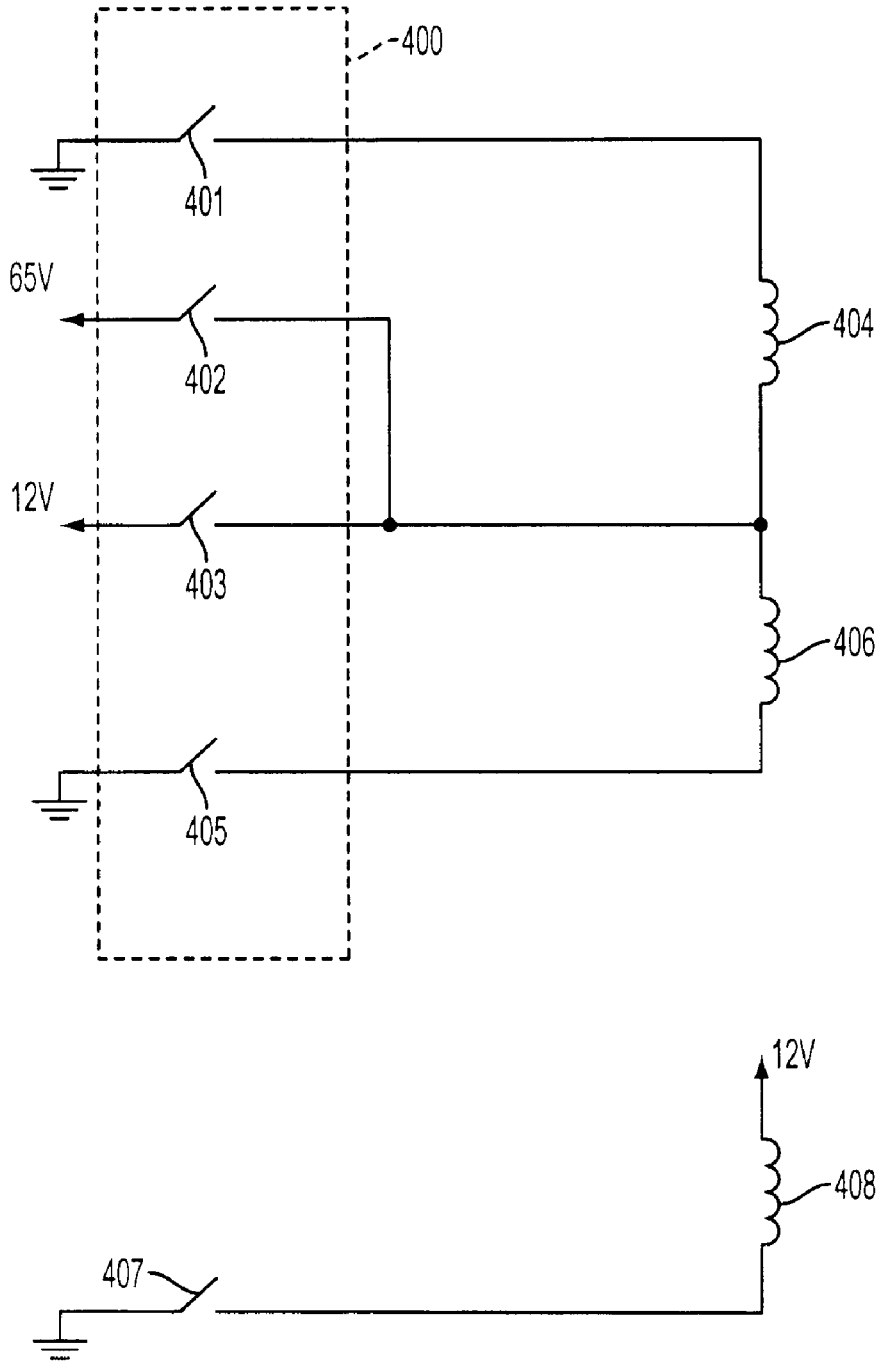
FIG. 4 PRIOR ART
FIG. 4 is an example circuit diagram for the prior art fuel injection system.

Referring now to FIG. 4, a schematic of example prior art DI and PFI injector circuitry is shown. A DI injection driver is labeled 400. The injection driver is comprised of several switches. Switch 401 is a defined as a low side driver because it creates a current path to a low potential when in the closed position. That is, current can be sunk to the lower potential when switch 401 is in the closed position. Switch 402 provides a current path to one of two higher potential voltage sources that provide power to DI injectors 404 and 406 when switch 402 is in the closed position. In addition, switch 402 is connected to switch 403 by way of a common node. This allows either higher potential voltage source to be connected to DI injectors 404 and 406. Switch 403 provides a current path to the second higher voltage source when in the closed position. To operate DI injectors 404 and 406, switch 402 is closed while switches 401 and 405 are closed. Switches 401 and 405 may be operated independently so that DI injectors 404 and 406 may be actuated at different crankshaft intervals. Providing voltage and current through switch 402 allows injectors 404 and 406 to operate at higher fuel injector pressures. After the injector is open, switch 403 is closed and switch 402 is opened. This reduces the amount of current flowing though the actuated injectors. In addition, switches 402 and 403 can be modulated to further reduce current flow to actuated injectors.

PFI injector 408 is supplied power through one terminal, and the other terminal is connected to switch 405. The switch provides a current sinking path to a lower reference when the switch is closed. As a result, the PFI injector is operated by opening and closing switch 407.

Note that when two PFI injectors and two DI injectors are configured to deliver fuel to two cylinders, an additional PFI wired similar to injector 408 is required.

Referring now to FIG. 5, one example circuit to reduce system wiring complexity and driver cost is shown.

Injector driver 500 is identical to injector driver 400 illustrated in FIG. 4. Switches 502 and 507 provide a first current path for sourcing between higher reference voltage supplies and DI injectors 503 and 509. When switches 502 and 507 are on simultaneously, a diode (not shown) in series with switch 507 prevents the 65V source from short circuiting to the 12V supply. The circuit also provides a second current path to a lower supply reference for sinking DI injector 503 current through switch 501. Switch 508 provides a third current path by allowing current from DI injector 509 and PFI injector 510 to be sunk to a low potential reference.

However, in this configuration, injector driver 500 is also capable of controlling PFI injectors 504 and 510. When switch 512 is commanded closed, PFI injectors 504 and 510 may be actuated by closing switches 501 and 508. Switch 512 may be common to controlling all PFI injectors. It can be used to enable or deactivate all PFI injectors. If it were to be modulated at high speed, it would be able to eliminate the need to share on times between some PFI and DI injectors. Diodes 506 and 511 prevent or significantly reduce current flow through injectors 504 and 510 if switch 512 is closed and switch 502 is closed. As a result, switch 512 can remain closed without actuating PFI injectors 504 and 510 during a cylinder cycle, if desired.

DI injector 503 and PFI injector 504 are configured in an engine to deliver fuel to different cylinders that are 360° out of phase. Likewise, DI injector 509 and PFI injector 510 are also configured to deliver fuel to different cylinders that are 360° out of phase. The PFI and DI injectors that are connected to a common switch can be simultaneously operated by the same switch if desired. For example, a four stroke four cylinder engine having a combustion order of 1-3-4-2 would have a first DI injector that delivers fuel to cylinder number one coupled to the same sinking driver as a second PFI injector delivering fuel to cylinder number four. When switch 502 or 507 is closed at the same time switch 501 is closed, DI injector 503 can inject fuel to the cylinder. When switches 512 and 501 are simultaneously closed, fuel is injected to the port of a different cylinder. If switch 512 is open and switch 501 is closed, PFI injector 504 will not inject fuel. If switch 502 or 507 is closed and switch 501 is open, DI injector 503 will not inject fuel. Diodes 506 and 511 limit current flow such that current has to flow through switch 512 or PFI injectors 504 and 510 will not operate. DI injector 509 and PFI injector 510 are operated in a similar manner.

This system configuration eliminates two wires and two switches by operating DI and PFI injectors by way of the same or common current sinking paths. By lowering the number of wires and drivers necessary to operate injectors, system cost and weight can be reduced.

Figure 6:
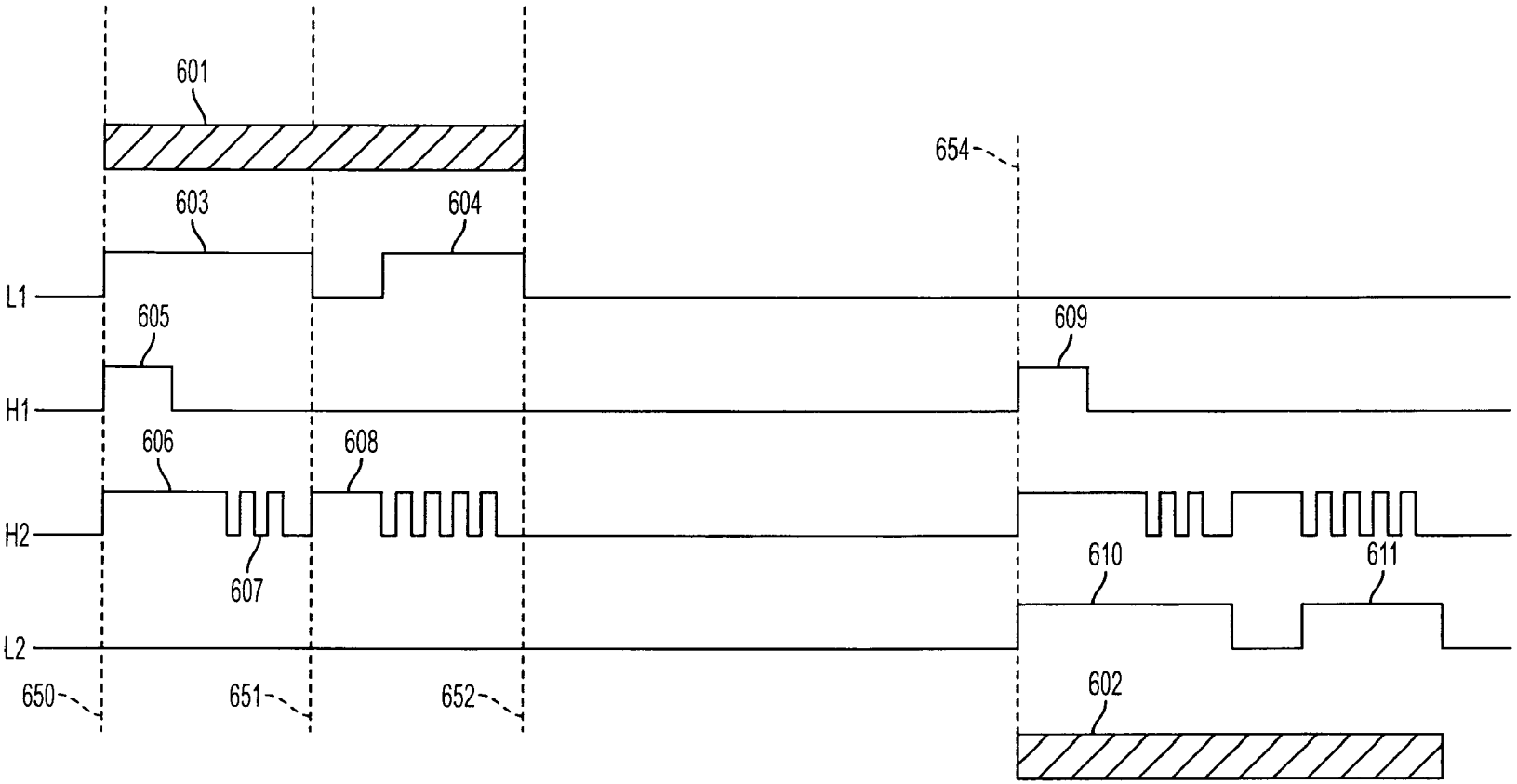
FIG. 6 is a timing diagram for the prior art fuel injection system.

Referring now to FIG. 6, a timing diagram for operating a pair of DI injectors using the DI driver circuit illustrated in FIG. 4 by the method of FIG. 2 is shown. The low side switch state is represented by the signal trace labeled L1. When the signal is high the switch is closed and the low side driver switch provides a current path from the DI injector to a low potential current sink. When the signal is low the switch is open and the low side driver stops current from flowing from the DI injector to the low potential current sink. The signal trace labeled L2 operates the same way as the trace labeled L1, but it operates a different DI injector at a different crankshaft angular interval.

The signal labeled H1 represents the state of the switch that controls sourcing of one higher potential voltage or current supply. When the H1 signal is high, the current sourcing control switch allows current to flow from the higher potential source of the two higher voltage or current sources to the DI injectors.

The signal labeled H2 represents the state of the switch that controls sourcing of the two higher voltage or current sources to the DI injectors. When the H2 and H1 signals are high, the current sourcing control switch allows current to flow from the highest available voltage or current source to the DI injector. H2 is lower in voltage or current potential than H1.

Areas 601 and 602 represent the DI injection timing for two different cylinders controlled by the switches that are labeled L1, L2, H1, and H2. That is, area 601 represents the time a first DI injector is commanded to inject fuel into a first cylinder and 602 represent the time a second DI injector is commanded to inject fuel to a second cylinder.

The operation of the DI injectors with respect to the illustrated signals will now be described. The injection sequence for a first cylinder begins at vertical marker 650. Low side driver L1, high side driver H1, and high side driver H2 are shown going high and provide current paths from the high side drivers to the low potential reference that is connected to L1. Current flows from the highest potential source during the period H1 is high 605. Current is sunk through the low side driver during period 603 when the low side switch is closed. After H1 goes low, H2 remains on at 606. Shortly thereafter H2 is modulated 607. Modulating the switch reduces current flow to the DI injector and reduces injector heating. At vertical marker 651, L1 goes low and H2 goes high. High side switch H2 provides a current path to circulate free wheeling current when the low side driver is set to an open state 608. Before the DI injector closes, L1 is closed and begins to conduct at 604. This sequence drops the current supplied to the DI injector but maintains enough current to keep fuel passing through the DI injector. At vertical marker 652, the DI injector is shut off and fuel flow stops. The injector is shut off by setting the high side and low side switches to a low or open state.

Vertical marker 654 identifies the beginning of opening the second injector of the injector pair driven by the injector driver. Like the sequence beginning at 650, the high side driver H1 is set to a high state along with H2 and L2. At this point the DI injector begins to open and inject fuel for the duration described by area 602. The sequence follows the same pattern as the sequence shown at 601.

This figure illustrates that high side injectors can be controlled independently from low side injectors so that two DI injectors can be driven by a single DI driver comprises of several switches or similarly controlled devices.

Figure 7:
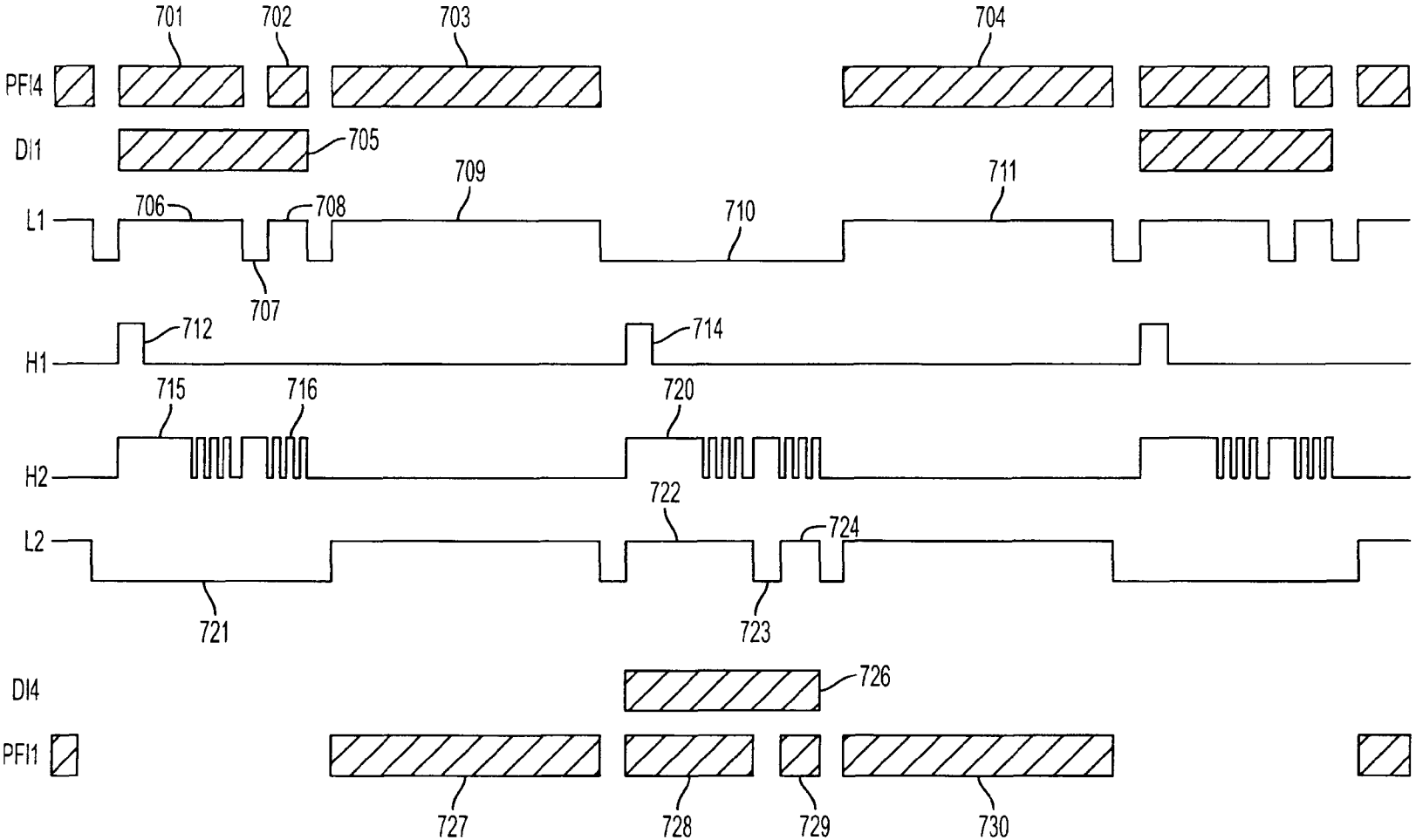
FIG. 7 is a timing diagram for the present fuel injection system.

Referring now to FIG. 7, a timing diagram for operating a pair of DI injectors and a pair of PFI injectors using the DI driver circuit illustrated in FIG. 5 is shown.

The low side switch states are represented by the signal traces labeled L1 and L2. When the signals are high, the switches are closed and the low side driver switches provide current paths from the DI injectors to low potential current sinks. When the signals are low, the switches are open and the low side driver stops current from flowing from the DI injectors to the low potential current sinks. L1 and L2 can be used to operate different DI injectors in different cylinders that are 360 crankshaft degrees out of phase, but the phase difference between cylinders can be increased or decreased by selecting cylinders that are not 360 crankshaft degrees out of phase, if desired.

The figure shows injection timing for DI and PFI injectors that operate with two different cylinders of a four cylinder engine having a firing order of 1-3-4-2. Injector PFI4, a port fuel injector that delivers fuel to cylinder number four, is paired with injector DI1, a direct injector that delivers fuel to cylinder number one, by connecting both injectors to low side driver L1. Thus, when L1 provides a low impedance path to a low potential reference, DI1 and PFI4 can operate and inject fuel to their respective associated cylinders. Likewise, injector DI4 is paired with injector PFI1 by way of low side injector L2. This allows L2 to operate DI4 and PFI1 when L2 provides a low impedance current path to a low potential reference.

In region 706, L1 is high which allows current from injectors DI1 and PFI4 to be sunk at the lower potential reference via a first current path. In region 707, current that flows to the low potential reference is stopped to reduce the amount of current flowing through DI1. Current is allowed to flow to the low potential reference at 708 when L1 goes high and conducts. L1 goes low after region 708 to stop current flow through DI1. Shortly thereafter, L1 goes high allowing current flow to resume through PFI4. Current flow to PFI4 is stopped before injector DI4 begins to inject fuel at 714. L1 goes high after the DI4 injection period is complete which allows additional fuel to flow through PFI4 injector.

The power delivered by the highest potential power injector source is controlled by the state of a high side driver. Trace H1 represents the state of this driver. When H1 is high, the driver is closed and current is permitted to flow from the source via a first current path to either injector of a DI injector pair. The H1 control command is short in duration because it is used initially open the DI injectors. After the injectors are open, power from the other high potential source is used to keep the DI injectors in the open position until they are closed. At 712 a first DI injector is opened. At 714 the second DI injector, different than the first DI injector, is opened. High side injector commands 712 and 714 occur 360 crankshaft angle degrees apart, but it is possible to separate the DI or PFI injections by more or less than 360 crankshaft angular degrees if desired.

The second higher potential injector power source is controlled by the state of a different high side driver labeled H2. The H2 driver closes and allows current to be sourced at substantially the same time that the H1 circuit closes. The H2 driver duration is longer and is modulated to reduce current flow to the individually actuated DI injector. Like the H1 driver, the H2 driver sources current to two individual DI injectors that operate with two different cylinders. In region 715 the second power source provides current to keep injector DI1 injecting fuel. In region 716, the high side driver H2 is modulated to reduce the current supplied to injector DI1.

Low side driver L2 follows substantially the same pattern as L1 but is 360 crankshaft angular degrees out of phase with L1. In region 721, L2 is held low to stop injector PFI1 from injecting fuel while DI1 is injecting fuel. In region 722, L2 goes high and allows current to flow through DI4 via a third current path that sinks current flowing through DI4. At 723, L2 goes low to reduce current flow through L2, and at 724, L2 goes high to provide a current path to the low potential reference.

The areas designated DI1 and DI4 represent the injection duration for DI injectors. Area 705 represents the first DI injection interval for the DI injecting fuel to cylinder one. The injection interval begins at the same time that H1, H2, and L1 go high. As described above, low side driver L1 conducts during the period labeled 706 and briefly goes open at 707. This current interruption marks the end of the injector pull-in phase or period and the beginning of current reduction in the hold phase. At 708, the low side driver again conducts and the injector is held in the open position with less current. The DI1 injection period stops and fuel flow stops when H2 and L1 go low at the end of pulse 708. During the period when DI1 is injecting fuel to cylinder 1 (705), low side driver L2 is held low so that injector DI4 does not conduct and inject fuel to cylinder number four. In this way, when injector DI1 injects fuel during the intake and/or compression stroke of cylinder number one, injector DI4 is stopped from injecting fuel into cylinder number four during cylinder number four compression and/or exhaust strokes. Notice that region 705 is not interrupted by L1 going low at 707. Freewheeling current keeps the injector closed during this interval.

During the DI1 injection period, port fuel injector PFI4 is delivering fuel to cylinder number four. PFI4 injects fuel at the time represented by area 701 and then stops, but it resumes at the time represented by area 702. PFI4 injector continues to inject fuel at the time or crankshaft interval represented by area 703. This corresponds to the time or crankshaft interval when L1 is high at 709. It should also be noted that injector PFI4 can be deactivated whether L1 is high or not by interrupting or disconnecting the PFI power source from the PFI injectors. Likewise, DI injectors can be deactivated by keeping high side drivers open. The PFI4 injection period is stopped when low side driver L1 goes low at 710. Low side driver L1 returns to the low state in time to stop fuel flow to PFI4 before DI4 injector is actuated and before fuel is injected into cylinder number four by injector DI4. PFI4 again delivers fuel to cylinder number one port during the time or crankshaft interval 704 while low side driver L1 is allowed to return high.

Fuel is directly injected to cylinder number four by injector DI4 at the time or crankshaft angle represented by area 726. During the DI4 injection period, high side drivers H1 and H2 operate similar to when injector DI1 is delivering fuel to cylinder number one. High side driver H1 goes high during the period 714 and then goes low to limit current flow to injector DI4. High side driver H2 supplies power to injector DI4 during the hold phase 720. Low side driver L2 conducts at 722, stops conducting at 723 to lower current to injector DI4, and then conducts again at 724 until the DI4 injection period ends.

PFI injector PFI1 is delivers fuel to the port of cylinder number one during the time or crankshaft interval denoted by areas 727, 728, 729, and 730. Similar to injector PFI4, injector PFI1 is allowed to inject fuel to the port of cylinder number one when low side driver L2 is shown high and current can be sunk. This allows injector PFI1 to inject before, during, and after the DI4 injection period. Thus, port fuel can be delivered to one cylinder while directly injected fuel is delivered to another cylinder by utilizing common injector drivers.

It should be noted that the timings illustrated are meant to merely convey injection timings of one cylinder with respect to injection timings of a second cylinder. As such, the timings may be shorter or longer than those illustrated without departing from the scope of intent of the present description. For example, the DI injection periods and the PFI injection periods can be reduced if less cylinder torque is requested. In another example, the DI injection periods may be the same while the PFI injection period is reduce. In still another example, the DI injection period may be increased while the port injection time is decreased. In still another example, the DI injection period may be decreased while the PFI injection period is increased.

It should also be noted that during the above described injection periods, high octane fuels such as ethanol, alcohols, propane, or methane may be injected to the cylinder during DI and/or PFI injection periods. Fuels having high heats of vaporization (i.e., ethanol and propane) may also be port of directly injected to achieve the advantages associated with port or cylinder cooling (i.e., knock resistance and increased charge density). Fuels with lower octane and higher knock tendency may also be selectively injected to facilitate HCCI combustion, if desired.

Figure 8:
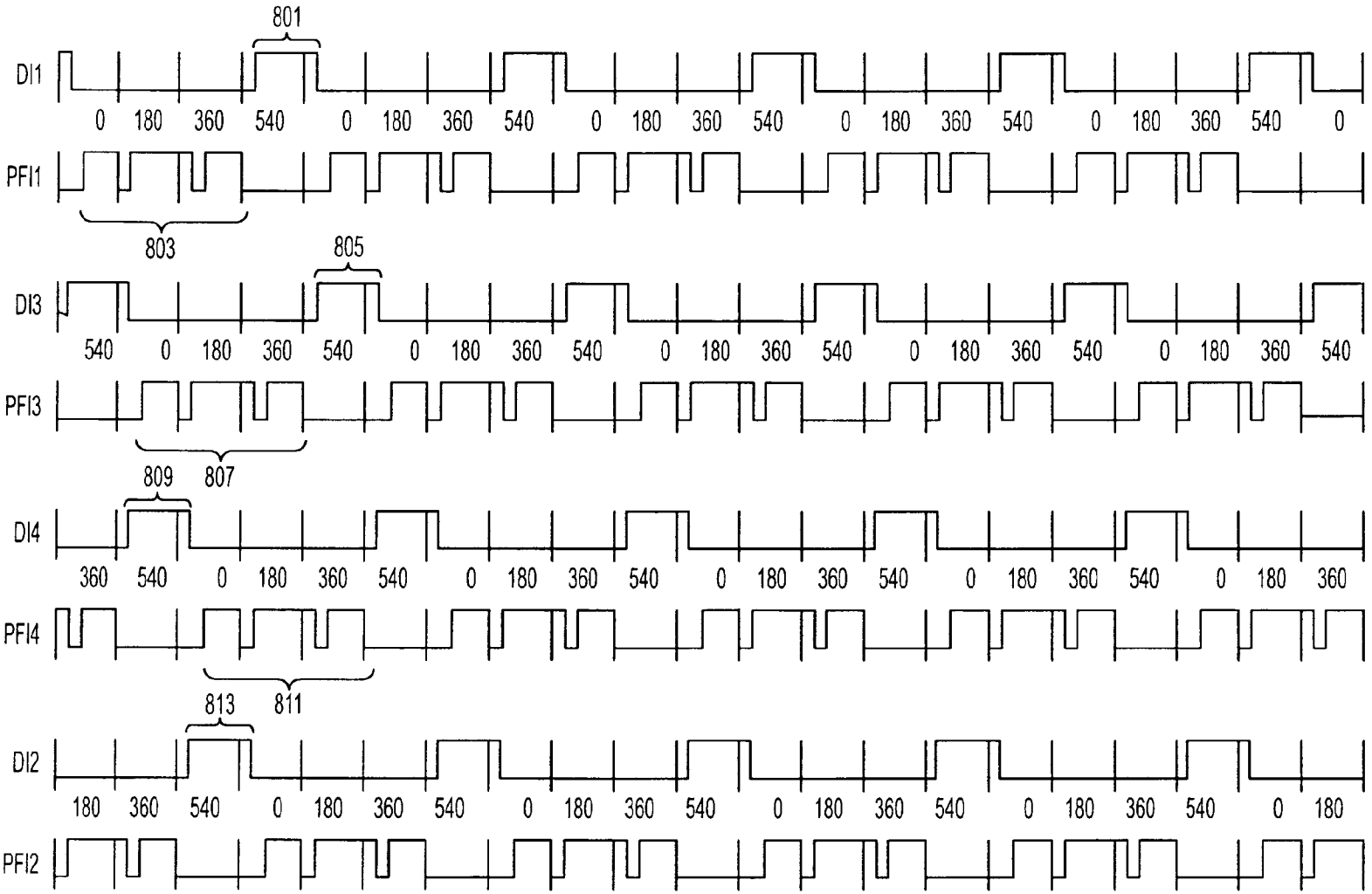
FIG. 8 is an injection sequence for the present fuel injection system configured for a four cylinder engine.

Referring now to FIG. 8, a timing diagram for the present system and method configured for a four cylinder engine is shown. Signal designations are displayed on the right hand side of the figure. Direct injector timing for cylinders 1-4 is labeled DI1-DI4. Port fuel injector timing for cylinders 1-4 is labeled PFI1-PFI4. The position of each cylinder with respect to when the individual cylinder position is at top-dead-center compression stroke is labeled below each direct injector control signal that is associated with the respective cylinders. The numbers correspond to the vertical marker to the right of each number. The timing moves from left to right.

FIG. 8 illustrates simulated example injection timing periods for DI and PFI injectors configured in the arrangement illustrated in FIG. 5 operated by the method of FIG. 2 for a four cylinder engine. When one of the illustrated signals is high fuel is injected, this interval corresponds to the time when the associated injector driver switch goes low and the injector has a current path to a low or high potential power source.

The first full visible injection period for DI1 is labeled 801. When DI1 is high fuel is directly injected into cylinder one. The injection timing for DI1 occurs during the intake and compression strokes of cylinder number one. Also note that PFI4 is injecting fuel to the port of cylinder four during the DI1 injection period. This occurs because the current sinking switch that can control DI1 and PFI4 is closed which allows current to flow through DI1 and PFI4. Likewise, PFI1 injector is coupled to the same current sinking driver as DI4. As a result, the first PFI1 injection period 803, is linked to the DI4 injection period 809 by way of the sinking current driver that is common to both injectors. In a similar manner, DI3 injection period 805, is related to the PFI2 injection period 815, and DI2 injection period 813, is related to PFI 807 through common sinking drivers. Thus, FIG. 8 shows an example of the relationships between cylinder injection periods for an engine that employs injector drivers configured similar to those described in FIG. 5. However, it should be noted that the injection periods shown in FIG. 8 may be increased or decreased without departing from the scope or intent of the present description.

The methods, routines, and configurations disclosed herein are exemplary and should not be considered limiting because numerous variations are possible. For example, the above disclosure may be applied to I3, I4, I5, V6, V8, V10, and V12 engines operating in natural gas, gasoline, diesel, or alternative fuel configurations.

The following claims point out certain combinations regarded as novel and nonobvious. Certain claims may refer to "an" element or "a first" element or equivalent. However, such claims should be understood to include incorporation of one or more elements, neither requiring nor excluding two or more such elements. Other variations or combinations of claims may be claimed through amendment of the present claims or through presentation of new claims in a related application. The subject matter of these claims should be regarded as being included within the subject matter of the present disclosure.

The invention claimed is:

1. A system for delivering fuel to a port of a cylinder and directly to said cylinder of an internal combustion engine, the system comprising:

a first port injector for injecting fuel to a port of a first cylinder;

a second port injector for injection fuel to a port of a second cylinder;

a first direct injector for injecting fuel directly to said first cylinder;

a second direct injector for injecting fuel directly to said second cylinder; and a controller configured to output a first command to actuate said first port injector to inject fuel to said first cylinder, said first command also acting to actuate said second direct injector to inject fuel to said second cylinder, and said controller also configured to output a second command to actuate said second port injector to inject fuel to said second cylinder, said second command also acting to actuate said first direct injector.

2. The system of claim 1 wherein one or more wiring connections between said port fuel injectors and said direct fuel injectors are made external to said controller.

3. The system of claim 2 further comprising passive semiconductors that limit the direction of current flow through said port injectors.

4. The system of claim 1 wherein said first command is effectuated by controlling a plurality of current paths comprising at least a first path whereby current is sourced and at least a second path whereby current is sunk.

5. The system of claim 4 wherein current that flows from said first port fuel injector is sunk through said second path.

6. The system of claim 4 wherein current flows from said first path to said second direct injector and current is sunk through said second path.

7. The system of claim 4 further comprising a third path whereby current flowing through said second port injector is sunk to actuate said second port injector.

8. The system of claim 7 wherein current flows from said first path to said first direct injector and is sunk through said third path.

9. A method for controlling fuel port and direct fuel injectors configured to deliver fuel to a cylinder of an internal combustion engine, the method comprising:

flowing a first current through a second direct injector to inject fuel to a second cylinder of an internal combustion engine by way of a first command;

flowing a second current through a first port injector so that fuel is injected to a first cylinder of said internal combustion engine during at least a portion of the interval when said second direct injector is injecting fuel to said second cylinder, said second current flowing by way of said first command and a second command.

10. The method of claim 9 wherein said first and second currents flow during substantially the same crankshaft angular interval.

11. The method of claim 9 wherein said second current is adjusted from a pull-in current to a hold current.

12. The method of claim 9 wherein said first current flows over a greater crankshaft interval than said second current.

13. The method of claim 9 wherein said first current causes fuel to be injected to said second cylinder during at least a portion of the intake or compression stroke.

14. The method of claim 9 wherein said second current causes fuel to be injected to said first cylinder during at least a portion of the power or exhaust stroke.

15. A method for controlling fuel port and direct fuel injectors configured to deliver fuel to a cylinder of an internal combustion engine, the method comprising:

flowing a first current through a second direct injector to inject fuel to a second cylinder of an internal combustion engine by way of a first command;

flowing a second current through a first port injector so that fuel is injected to a first cylinder of an internal combustion engine during at least a portion of the interval when said second direct injector is injecting fuel to said second cylinder, said second current flowing by way of said first command and a second command; and stopping said first current and injecting additional fuel to said first cylinder during the same cylinder cycle.

16. The method of claim 15 wherein said first current causes a higher octane fuel to flow to said second cylinder.

17. The method of claim 15 wherein said first current causes fuel to be injected to said second cylinder during at least a portion of the intake or compression stroke.

18. The method of claim 15 wherein said first current is stopped during the compression stroke and wherein said second current flows during the power stroke of said first cylinder.

19. The method of claim 18 wherein said second current flows through at least a portion of the exhaust stroke of said first cylinder.

20. A method for controlling fuel port and direct fuel injectors configured to deliver fuel to a cylinder of an internal combustion engine, the method comprising:

a first mode wherein a first current flows through a second direct injector to inject fuel to a second cylinder of an internal combustion engine by way of a first command, and wherein a second current flows through a first port injector so that fuel is injected to a first cylinder of said internal combustion engine during at least a portion of the interval when said second direct injector is injecting fuel to said second cylinder, said second current flowing by way of said first command and a second command;

a second mode wherein said third current flows through said second direct injector to inject fuel to said second cylinder of said internal combustion engine by way of a third command, and wherein fuel in not injected by said first port injector during the cylinder cycle wherein said third current flows.

21. The method of claim 20 wherein said first current is stopped during the compression stroke and wherein said second current flows during the power stroke of said first cylinder.

22. The method of claim 21 wherein said second current flows through at least a portion of the exhaust stroke of said first cylinder.

23. A circuit for operating a pair of direct fuel injectors configured to deliver fuel to a first and a second cylinder, and for operating a pair of port fuel injectors delivering fuel to said first and second cylinders, the circuit comprising:

a first current path whereby current is sourced to first and second direct injectors that are capable of injecting fuel to two different cylinders;

a second current path that may provide a current sinking capacity for said first direct injector and a second port fuel injector;

a third current path that may provide a current sinking capacity for said second direct injector and a first port fuel injector; and first and second switches that close or open said second and third current paths to actuate or deactivate said first and second direct injectors and said first and second port fuel injectors.

24. The circuit of claim 23 further comprising diodes to limit the direction of current flow.

25. The circuit of claim 23 further comprising a plurality of power sources supplying current to said circuit.

* * * * *